US011686478B2

(12) United States Patent
Deokar

(10) Patent No.: US 11,686,478 B2
(45) Date of Patent: Jun. 27, 2023

(54) GRILLE ASSEMBLY FOR AIR HANDLING UNIT

(71) Applicant: Rheem Manufacturing Company, Atlanta, GA (US)

(72) Inventor: Pratik S. Deokar, Lewisville, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 123 days.

(21) Appl. No.: 17/132,501

(22) Filed: Dec. 23, 2020

(65) Prior Publication Data

US 2022/0196258 A1 Jun. 23, 2022

(51) Int. Cl.
*F24F 1/56* (2011.01)

(52) U.S. Cl.
CPC ..... *F24F 1/56* (2013.01)

(58) Field of Classification Search
CPC ..... F24F 1/56; F24F 1/48; F24F 1/50; F24F 13/08; F24F 13/082
See application file for complete search history.

(56) References Cited

U.S. PATENT DOCUMENTS 7,172,387 B2 * 2/2007 Yamamoto ..... F24F 1/38 415/121.2
11,168,899 B2 * 11/2021 Dygert ..... F24F 1/0323

* cited by examiner

*Primary Examiner* — Henry T Crenshaw
*Assistant Examiner* — Kamran Tavakoldavani
(74) *Attorney, Agent, or Firm* — Eversheds-Sutherland (US) LLP

(57) ABSTRACT

A grille assembly for an air handling unit is provided. The grille assembly includes a plurality of first wires aligned in a first plane perpendicular to a direction of flow of air and a plurality of second wires aligned in a second plane perpendicular to the direction of flow of air. The plurality of first wires and the plurality of second wires together form a staggered structure to at least partly enclose an air passage opening of the air handling unit. The second plane is parallel to the first plane and separated by an offset distance along a third plane parallel to the direction of flow of air.

19 Claims, 10 Drawing Sheets

GRILLE ASSEMBLY FOR AIR HANDLING UNIT

TECHNICAL FIELD

The present disclosure relates, in general, to a fan grille, and more specifically relates to a grille assembly for an air handling unit.

BACKGROUND

Heat pumps, air conditioners or any cooling and heating systems use ambient air for the operation of the systems and the ambient air is maneuvered with the help of multiple rotating blades. Typically, the outdoor units of such systems include the multiple rotating blades. As the multiple rotating blades are used to maneuver the ambient air, the rotating blades are disposed adjacent to an air passage opening of the housing of such systems. Therefore, to prevent entry of externals objects and to act as a safety guard to avoid accidents such as, injury to living creatures from the rotating blades, fan grilles are attached to the housing to enclose the air passage opening as well as the rotating blades. Further, the fan grilles are also implemented in appliances in which rotating blades are used for discharging air, for safety of the fan blades from external factors and safety of living creatures from the fan blade.

Typically, the performance of the cooling and heating systems depends on various factors including the performance of heat exchanger, which in turn depends on the volume of air received within the system. A higher volume of air received within the system will lead to higher performance of the heat exchanger and hence a higher operational efficiency of the system. Known design and construction of the fan grille assembly is associated with certain obstruction to the flow of air due to the wire configuration and with noise due to the flow of air through the wires. Hence, there remains a need to develop a grille assembly that can facilitate increased volume of air received within the system to further improve operational efficiency of the system while reducing undesired characteristics such as obstruction of air flow or noise levels.

SUMMARY

According to one aspect of the present disclosure, a grille assembly for an air handling unit is disclosed. The grille assembly includes a plurality of first wires aligned in a first plane perpendicular to a direction of flow of air and a plurality of second wires aligned in a second plane perpendicular to the direction of flow of air. The plurality of first wires and the plurality of second wires are together configured to form a staggered structure to at least partly enclose an air passage opening of the air handling unit. The second plane is parallel to the first plane and separated by an offset distance along a third plane parallel to the direction of flow of air. The grille assembly further includes a plurality of wires aligned in one or more planes defined adjacent the first plane or the second plane, wherein the one or more planes are parallel to the first plane or the second plane.

The staggered structure includes each of the plurality of first wires formed as a single wire and spirally disposed on the plurality of ribs in the first plane and each of the plurality of second wires formed as a single wire and spirally disposed on the plurality of ribs in the second plane. In another embodiment, the staggered structure includes each of the plurality of first wires and each of the plurality of second wires individually defining a ring shape and concentrically disposed on the plurality of ribs in the first plane and the second plane, respectively. In yet another embodiment, the staggered structure includes each of the plurality of first wires and each of the plurality of second wires extending radially away from a central axis of the grille assembly and aligned in the first plane and the second plane, respectively.

The offset distance depends on a horizontal distance between two adjacent wires along the first plane, in which the two adjacent wires include the first wire and the second wire. The horizontal distance between the two adjacent wires is in a range of about 0.2 in to about 1.75 in. In another embodiment, the offset distance depends on an angle between an inclined plane defined by two adjacent wires and the first plane, in which the two adjacent wires include the first wire and the second wire. The angle between the inclined plane and the first plane is in a range of about 5 degrees to about 80 degrees. In yet another embodiment, the offset distance depends on a thickness of the first wire and the second wire. The thickness of the first wire and the second wire is in a range of about 0.05 in to about 0.16 in. The grille assembly further includes a plurality of ribs configured to support each of the plurality of first wires and each of the plurality of second wires in the first plane and the second plane, respectively.

In one embodiment, each of the plurality of first wires and each of the plurality of second wires have a circular cross section. In another embodiment, each of the plurality of first wires and each of the plurality of second wires have a rectangular cross section. In yet another embodiment, each of the plurality of first wires and each of the plurality of second wires have an aerofoil cross section.

According to another aspect of the present disclosure, a grille assembly for an air handling unit is disclosed. The grille assembly includes a plurality of first wires aligned in a first plane perpendicular to a direction of flow of air and a plurality of second wires aligned in a second plane perpendicular to the direction of flow of air. The plurality of first wires and the plurality of second wires are together configured to form a staggered structure to at least partly enclose an air passage opening of the air handling unit. The second plane is parallel to the first plane and separated by an offset distance along a third plane parallel to the direction of flow of air. The offset distance depends on a horizontal distance between two adjacent wires along the first plane and an angle between an inclined plane defined by the two adjacent wires and the first plane, in which the two adjacent wires include the first wire and the second wire. The offset distance further depends on a thickness of the first wire and the second wire.

According to yet another aspect of the present disclosure, a grille assembly is disclosed. The grille assembly includes a plate and a plurality of ribs having first ends coupled to the plate and second ends distal to the first ends and extending radially away from the plate. The grille assembly further includes a first wire defining a first set of loops aligned in a first plane perpendicular to a direction of flow of air and a second wire defining a second set of loops aligned in a second plane perpendicular to the direction of flow of air. The first wire and the second wire are radially disposed on the plurality of ribs and together configured to form a staggered structure to at least partly enclose an air passage opening of the air handling unit. The second plane is parallel to the first plane and separated by an offset distance along a third plane parallel to the direction of flow of air. The offset distance depends on a horizontal distance between two adjacent wires along the first plane and an angle between an inclined plane defined by the two adjacent wires and the first plane, in which the two adjacent wires include the first wire and the second wire. The offset distance further depends on a thickness of the first wire and the second wire.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
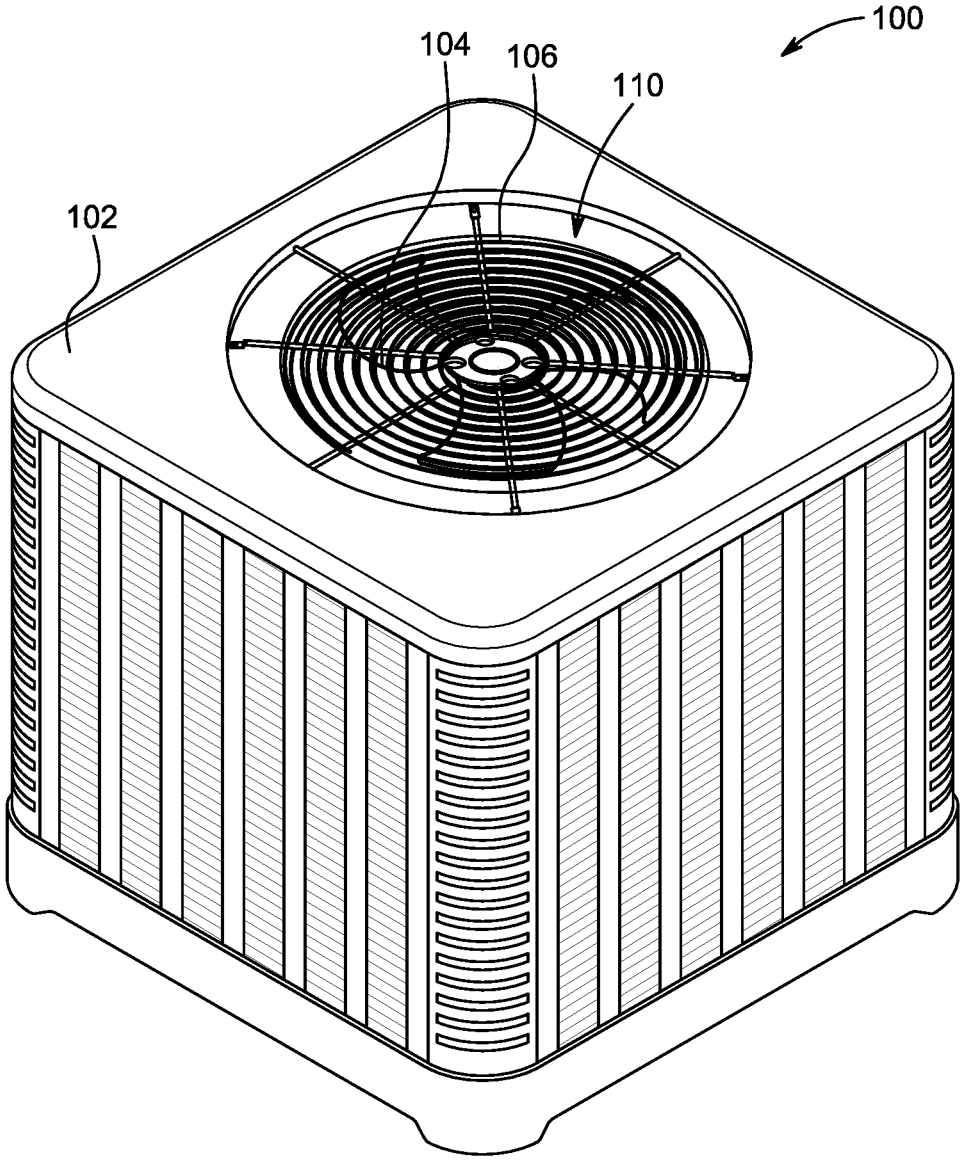
FIG. 1 is a perspective view of an air handling unit showing a grille assembly, according to an embodiment of the present disclosure.

Referring to FIG. 1, a perspective view of an air handling unit 100 is illustrated, according to an embodiment of the present disclosure. The air handling units 100 may include, but are not limited to, air conditioners, heat pumps and any known heating and cooling systems. The air handling unit 100 may be used for residential, commercial and any other known industrial applications. The air handling unit 100 may include two or more subunits which may be categorized as indoor units and outdoor units. In an example, the air handling unit 100 such as an air conditioner or a heating and cooling system may include an indoor unit kept in a closed space for conditioning air therein and an outdoor unit kept outside the closed space to utilize ambient air to exchange heat between the ambient air and a heat exchanger. Such outdoor unit may include rotating blades to maneuver ambient air to improve operating efficiency of the heat exchanger and hence the performance of the air handling unit 100. In an embodiment of the present disclosure, an outdoor unit of the air handling unit 100 is shown in FIG. 1.

The air handling unit 100 includes a housing 102 to accommodate a heat exchanger and various components thereof. The air handling unit 100 further includes rotating blades 104 disposed proximate an air passage opening 106 defined in the housing 102. The rotating blades 104 are configured to maneuver ambient air through the air passage opening 106 of the housing 102 and discharge pressurized air over the heat exchanger. The air handling unit 100 further includes a grille assembly 110 attached to the housing 102 to cover the air passage opening 106 such that external objects are restricted from entering therethrough. Further, the grille assembly 110 may act as a safety guard to avoid accidents such as, injury to living creatures from the rotating blades 104 when the air handling unit 100 is running.

Figure 2:
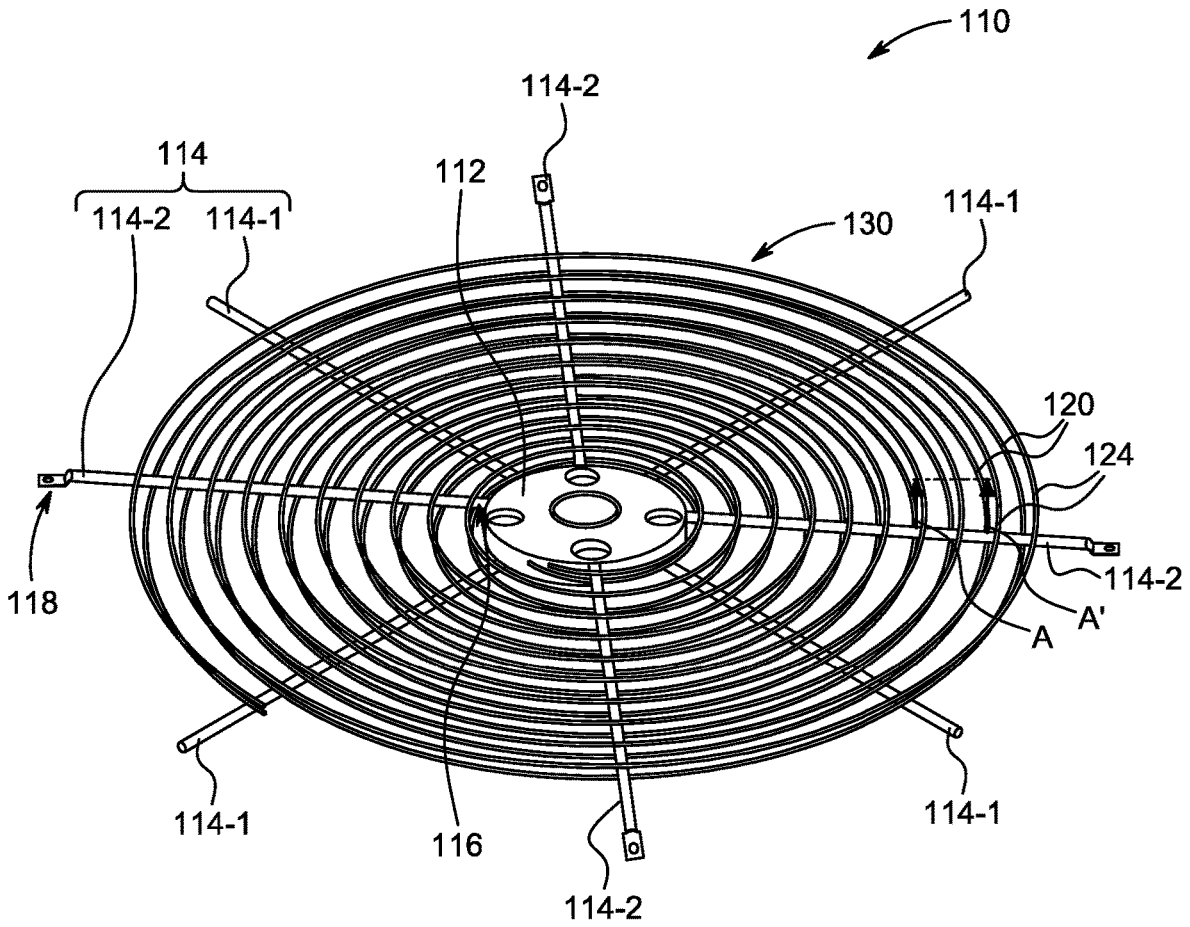
FIG. 2 is a perspective view of the grille assembly, according to an embodiment of the present disclosure.

Referring to FIG. 2, a perspective view of the grille assembly 110 shown in FIG. 1 is illustrated, according to an embodiment of the present disclosure. The grille assembly 110 includes a plate 112 and a plurality of ribs 114 extending radially away from the plate 112. In an embodiment, each rib 114 may be a cylindrical rod having a first end 116 configured to couple with the plate 112 and a second end 118 configured to couple with a peripheral edge of the air passage opening 106. In one embodiment, the air passage opening 106 of the housing 102 may have a circular shape. As such, the second end 118 of the ribs 114 is configured to couple with a circumferential edge of the air passage opening 106. In some embodiments, the air passage opening 106 may have a square shape, a rectangular shape, an oval shape, or any other polygon shape known in the art.

The grille assembly 110 further includes a plurality of first wires 120 aligned in a first plane 122 (shown in FIG. 3) perpendicular to a direction of flow of air 'F' and a plurality of second wires 124 aligned in a second plane 126 (shown in FIG. 3) perpendicular to the direction of flow of air 'F'. Particularly, each of the plurality of first wires 120 and each of the plurality of second wires 124 are supported by each of the plurality of ribs 114 in the first plane 122 and the second plane 126, respectively. Each of the plurality of first wires 120 and each of the plurality of second wires 124 radially spread across a length of each rib 114 defined between the first end 116 and the second end 118 thereof. As such, the plurality of first wires 120 and the plurality of second wires 124 are together configured to form a staggered structure 130 to at least partly enclose the air passage opening 106 of the housing 102 and thereby the rotating blades 104 disposed within the housing 102.

The second plane 126 defined by the plurality of second wires 124 is parallel to the first plane 122 defined by the plurality of first wires 120, thereby each of the plurality of first wires 120 and the second wires 124 render a staggered configuration to the grille assembly 110. In one embodiment, the plurality of first wires 120 may be formed as a single wire with multiple loops spirally and radially disposed on the ribs 114 in the first plane 122 and the plurality of second wires 124 may be formed as a single wire with multiple loops spirally and radially disposed on the ribs 114 in the second plane 126. Each of the plurality of first wires 120 and the plurality of second wires 124 may be alternatively and radially disposed on the first plane 122 and the second plane 126, respectively, to form the staggered structure 130. In an example, the loops defined by each of the plurality of first wires 120 and each of the plurality of second wires 124 may have a circular shape, a square shape, a rectangular shape, an oval shape or any other polygon shape known in the art. In another embodiment, the grille assembly 110 may include a first wire defining a first set of loops, alternatively referred to as the first wire 120, and a second wire defining a second set of loops, alternatively referred to as the second wire 124, spirally and radially disposed on each of the plurality of ribs 114. The first set of loops of the first wire 120 and the second set of loops of the second wire 124 may be aligned in the first plane 122 and the second plane 126, respectively. Each loop of the first wire 120 and each loop of the second wire 124 are disposed at equal distance with respect to each other across the length of each rib 114.

Figure 3:
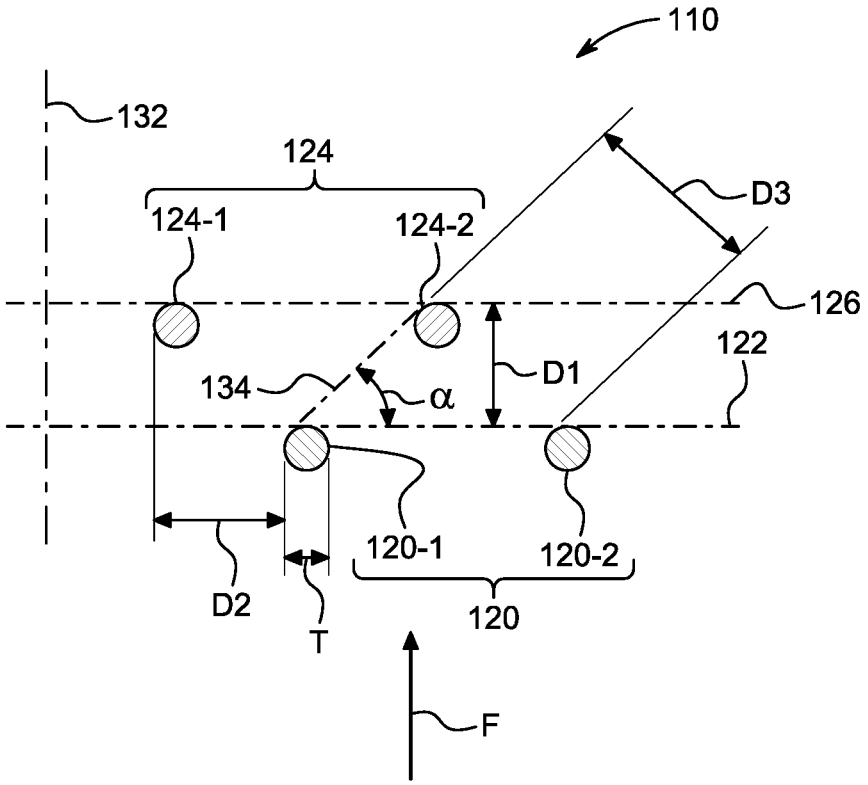
FIG. 3 is a cross-sectional view of the grille assembly taken along line A-A' of FIG. 2, according to an embodiment of the present disclosure.

Referring to FIG. 3, a sectional view of the grille assembly 110 taken along a line A-A' of FIG. 2 is illustrated, according to an embodiment of the present disclosure. Referring to FIG. 2 and FIG. 3, each of the plurality of first wires 120 and each of the plurality of second wires 124 have a circular cross section. Further, each of the plurality of first wires 120 is disposed in the first plane 122 and each of the plurality of second wires 124 is disposed in the second plane 126, in which the second plane 126 is distal to the first plane 122 by an offset distance 'D1'. The offset distance 'D1' is measured as a distance between the first plane 122 and the second plane 126 along a third plane 132 parallel to the direction of flow of air 'F'. In an alternate embodiment, the distance between the first plane 122 and the second plane 126 may be determined in terms of a vertical separation factor (a non-dimensional value) based on a mathematical relation between center to center distance between the first wire 120 and the second wire 124, or the offset distance 'D1', and a thickness 'T' of each of the first wire 120 and the second wire 124. The thickness 'T' of each of the first wire 120 and the second wire 124 is identical. For an example, the vertical separation factor=(center to center distance between the first wire 120 and the second wire 124)/(thickness 'T' of each of the first wire 120 and the second wire 124).

In one embodiment, the grille assembly 110 may include a first set of ribs 114-1 to support the plurality of first wires 120 in the first plane 122 and a second set of ribs 114-2 to support the plurality of second wires 124 in the second plane 126. In another embodiment, the rib 114 may have a corrugated profile having crests and troughs between the first end 116 and the second end 118 thereof such that each of the plurality of first wires 120 may be supported at the troughs of the ribs 114 and the plurality of second wires 124 may be supported at the crests of the ribs 114. The crests and troughs of the ribs 114 may be defined based on the offset distance 'D1' between the second plane 124 and the first plane 120.

For the sake of brevity and clarity, the sectional view of FIG. 3 is illustrated with two first wires 120 and two second wires 124 disposed in the first plane 122 and the second plane 126, respectively. The two first wires are individually designated as 120-1 and 120-2, and collectively designated as 120 unless otherwise specifically mentioned. Similarly, the two second wires 124 are individually designated as 124-1 and 124-2, and collectively designated as 124 unless otherwise specifically mentioned. The two first wires 120 are disposed in the first plane 122 and the two second wires 124 are disposed in the second plane 126, in which the second plane 126 is distal to the first plane 122 by the offset distance 'D1'. As shown in the FIG. 3, each of the two first wires 120 and each of the two second wires 124 are alternatively disposed in the first plane 122 and the second plane 126, respectively.

In one embodiment, the offset distance 'D1' between the first plane 122 and the second plane 126 depends on a horizontal distance 'D2' measured between two adjacent wires along the first plane 122. The two adjacent wires include the first wire 120-1 disposed in the first plane 122 and the second wire 124-1 disposed in the second plane 126. In an alternate embodiment, a distance between the first wire 120-1 and the second wire 124-1 may be determined in terms of a horizontal separation factor (a non-dimensional value) based on a mathematical relation between center to center distance between the first wire 120-1 and the second wire 124-1, or the horizontal distance 'D2', and the thickness 'T' of each of the first wire 120-1 and the second wire 124-1. For an example, the horizontal separation factor=(center to center distance between the first wire 120-1 and the second wire 124-1)/(thickness 'T' of each of the first wire 120-1 and the second wire 124-1). In an example, the horizontal separation factor may be in a range of about 4 to 11. In an embodiment, the horizontal distance 'D2' between the first wire 120-1 and the second wire 124-1 may be in a range of about 0.2 in to about 1.76 in. The horizontal distance 'D2' may be determined based on a mathematical relation between the horizontal separation factor and the thickness 'T' of one of the first wire 120-1 and the second wire 124-1. In an example, the horizontal distance 'D2'=(horizontal separation factor)×(thickness 'T' of one of the first wire 120-1 and the second wire 124-1). In another embodiment, the horizontal distance 'D2' may be in a range of about 0.3 in to about 1.21 in. In yet another embodiment, the horizontal distance 'D2' may be in a range of about 0.3 in to about 1.0 in.

In another embodiment, the offset distance 'D1' depends on an angle 'α' defined between an inclined plane 134 defined by two adjacent wires and the first plane 122, in which the two adjacent wires include the first wire 120-1 and the second wire 124-2. In an embodiment, the angle 'α' between the inclined plane 134 and the first plane 122 is in a range of about 5 degrees to about 80 degrees. In another embodiment, the angle 'α' between the inclined plane 134 and the first plane 122 may be in a range of about 35 degrees to about 65 degrees. In yet another embodiment, the angle 'α' may be in a range of 35 degrees to about 45 degrees.

In some embodiments, the offset distance 'D1' is determined based on the horizontal distance 'D2' and the angle 'α'. Further, a linear distance 'D3' between the first wire 120-2 disposed in the first plane 122 and the second wire 124-2 disposed in the second plane 126 may be determined based on the horizontal distance 'D2' and the angle 'α'. The linear distance 'D3' may be defined as a distance measured along a line extending between the first wire 120-2 disposed in the first plane 122 and the second wire 124-2 disposed in the second plane 126. Particularly, the linear distance 'D3' between the two adjacent wires is determined in such a way that an object having a size greater than 0.5 in is restricted from entering through the grille assembly 110. In an alternate embodiment, the distance between the first wire 120-2 and the second wire 124-2 may be determined in terms of a linear separation factor (a non-dimensional value) based on a mathematical relation between center to center distance between the first wire 120-2 and the second wire 124-2, or the linear distance 'D3', and the thickness 'T' of each of the first wire 120-2 and the second wire 124-2. For an example, the linear separation factor=(center to center distance between the first wire 120-2 and the second wire 124-2)/(thickness 'T' of each of the first wire 120-2 and the second wire 124-2).

In certain embodiments, the offset distance 'D1' may be further determined based on the thickness 'T' of each of two adjacent wires, in which the two adjacent wires include the first wire 120 and the second wire 124. Further, the horizontal distance 'D2' and the linear distance 'D3' may be defined based on the thickness 'T' of the first wire 120 and the second wire 124. The thickness 'T' of the first wire 120 and the second wire 124 may be measured along the first plane 122 or the second plane 126 defined perpendicular to the direction of flow of air 'F'. In an example, the thickness 'T' of the first wire 120 and the second wire 124 may be in a range of about 0.10 in to 0.15 in.

In an exemplary method of determining the offset distance 'D1' between the first plane 122 and the second plane 126, the horizontal distance 'D1' between the first wire 120-1 and the second wire 124-1 is maintained constant while increasing a value of the angle 'α' from zero degree. As such, the offset distance 'D1' keeps increasing and hence the linear distance 'D3'. Consequently, an area defined between the adjacent first wire 120 and the second wire 124 increases compared to that defined between two adjacent wires when the angle is zero degree or close to zero degree. The area defined between the first wire 120 and the second wire 124 may be alternatively referred to as 'open area' for the air to flow therethrough. Therefore, increasing the angle 'α' causes increase in the linear distance 'D3' between the first wire 120 and the second wire 124 and the offset distance 'D1' between the first plane 122 and the second plane 126, and hence the open area available for the air to flow therethrough. For example, spacing between the two adjacent wires, alternatively, the linear distance 'D3' between the first wire 120 and the second wire 124, is maintained less than or equal to 0.5 in. The linear distance 'D3' between the first wire 120 and the second wire 124 may be in a range of about 0.25 in to about 0.5 in. Such increase in the open area further leads to increase in the rate of flow of air through the grille assembly 110, which in turn leads to increase in the quantity of air discharged through the grille assembly 110. The quantity of air discharged through the grille assembly 110 is measured in terms of cubic feet per minute (CFM). In an example, with the staggered configuration of the grille assembly 110, the CFM may be increased by 5 to 15 percentage over the existing grille assembly design.

Further design analysis of the staggered configuration of the present disclosure may include consideration of the Reynolds number. The air flow over the grille assembly 110 may occur within low to intermediate subcritical Reynolds number range (Re<=1e4, Zhou, Y., & Alam, M. M. (2016). Wake of two interacting circular cylinders: a review. International Journal of Heat and Fluid Flow, 62, 510-537.). The horizontal separation factor greater than 4 would prevent wire wake interference for α=zero degree. For staggered configuration, the wire wake interference may be avoided as the linear separation factor is maintained greater than 4. Further, the plurality of the first wires 120 and the second wires 124 may be made rigid and fastened to the ribs 114, such that oscillation and vibration in the plurality of the first wires 120 and the second wires 124 caused by combination of lift force and drag force may be prevented. Maintaining the linear separation factor greater than 4 and the angle 'α' greater than 35 may lead to no impact or less impact of drag force and lift force in between the first wires 120 and the second wires 124, in case of Reynolds number to a high subcritical value of Re=5.5e4 (Zhou & Alam 2016). As such, excessive stress on joints where the first wires 120 and the second wires 124 are connected to the ribs 114 may be prevented.

In addition, the angle 'α' may be defined within a limit as larger angle 'α' may lead to higher linear separation factor which in turn lead to entry of external objects easily through the grille assembly 110 and thereby create safety concerns. The grille assembly 110 of the present disclosure limits any foreign object less than 0.5 in to pass through the first wires 120 and the second wires 124. The spacing or the safe limit between the adjacent first wire 120 and the second wire 124 may be determined based on a mathematical relation between the linear separation factor and the thickness 'T' of each of the first wire 120 and the second wire 124. In one example, safe limit=((linear separation factor×T)−T), which is equal to 0.5 in or lesser). In another example, safe limit=1+(0.5 in)/T. Particularly, a difference value between the linear distance 'D3' and the thickness 'T' of one of the first wire 120 and the second wire 124 may be equal to the safe limit of 0.5 in. Further, the angle 'α' may be restricted to lower limit by 35 degrees or higher and upper limit by a value determined based on a formula "$\cos^{-1}$(horizontal separation factor/safe limit)". The flow improvement characteristics of the grill assembly 110 of the present disclosure is applicable to air flow at low to high subcritical Reynolds number.

Figure 4:
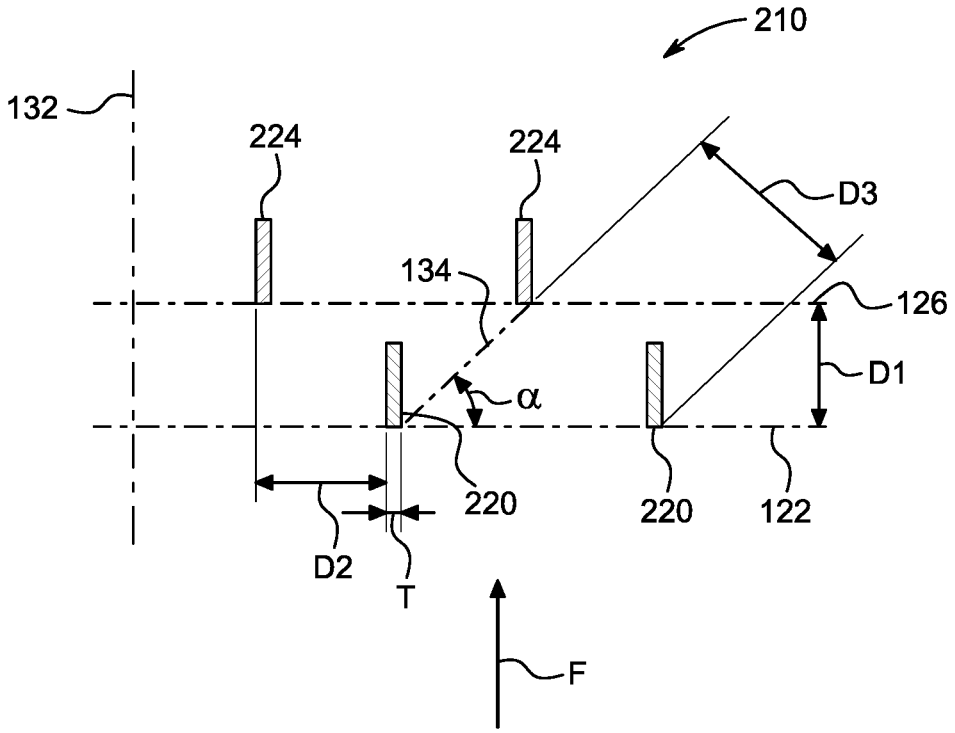
FIG. 4 is a cross-sectional view of wires of a grille assembly identical to FIG. 3, according to one embodiment of the present disclosure.

Referring to FIG. 4, a cross-sectional view of a grille assembly 210 is illustrated as shown in FIG. 3, according to an embodiment of the present disclosure. The construction of the grille assembly 210 is identical to the grille assembly 110 described with reference to the FIG. 2. The grille assembly 210 includes a plurality of first wires 220 disposed in the first plane 122 and a plurality of second wires 224 disposed in the second plane 126. Each of the plurality of first wires 220 and each of the plurality of second wires 224 may be supported by the ribs 114 in the first plane 122 and the second plane 126, respectively, and together configured to form the staggered structure 130 to enclose the air passage opening 106 and the rotating blades 104 within the housing 102. Each of the plurality of first wires 220 and each of the plurality of second wires 224 have a rectangular cross section. The rectangular cross section of each of the plurality of first wires 220 and the second wires 224 has a length aligned parallel to the direction of flow of air 'F' and has a width, alternatively referred to as the thickness 'T' of the first wire 220 or the second wire 224, aligned perpendicular to the direction of flow of air 'F'. Further, the length is aligned perpendicular to the first plane 122 or the second plane 126 and the width is aligned parallel to the first plane 122 or the second plane 126. In an embodiment, the length may be 4.5 times greater than the width, and hence the first wire 220 or the second wire 224 with the rectangular cross section has a higher aspect ratio.

The open area for the grille assembly 210 may be determined based on the offset distance 'D1' measured between the first plane 122 defined by the plurality of first wires 220 and the second plane 126 defined by the plurality of second wires 224 along the third plane 132. The offset distance 'D1' may be further determined based on the angle 'α' defined between the inclined plane 134 and the first plane 120. Further, the offset distance 'D1' may be determined based on the horizontal distance 'D2' between the first wire 220 in the first plane 122 and the second wire 224 in the second plane 126 along the first plane 122. The offset distance 'D1' may be further determined based on the thickness 'T', or the width, of each of the plurality of first wires 220 and each of the plurality of second wires 224. The thickness 'T' of each of the first wire 220 and the second wire 224 is identical. In an example, the thickness 'T' of the first wire 220 and the second wire 224 may be in a range of about 0.07 in to 0.10 in.

In an embodiment, each of the plurality of first wires 220 and each of the plurality of second wires 220 may be a thin strip made of a metal or a plastic. With the thin strip arrangement having the higher aspect ratio, the open area for the air flow may be increased in consequence of less obstruction to air flow. Therefore, the quantity of air discharged through the grille assembly 210 is increased. Further, as the length of the thin strips are aligned parallel to the direction of flow of air 'F', the structural rigidity of the grille assembly 210 may be further improved. In an example, with the staggered configuration of the grille assembly 210, the CFM may be increased by 10 to 20 percentage over the existing grille assembly design.

Figure 5A:
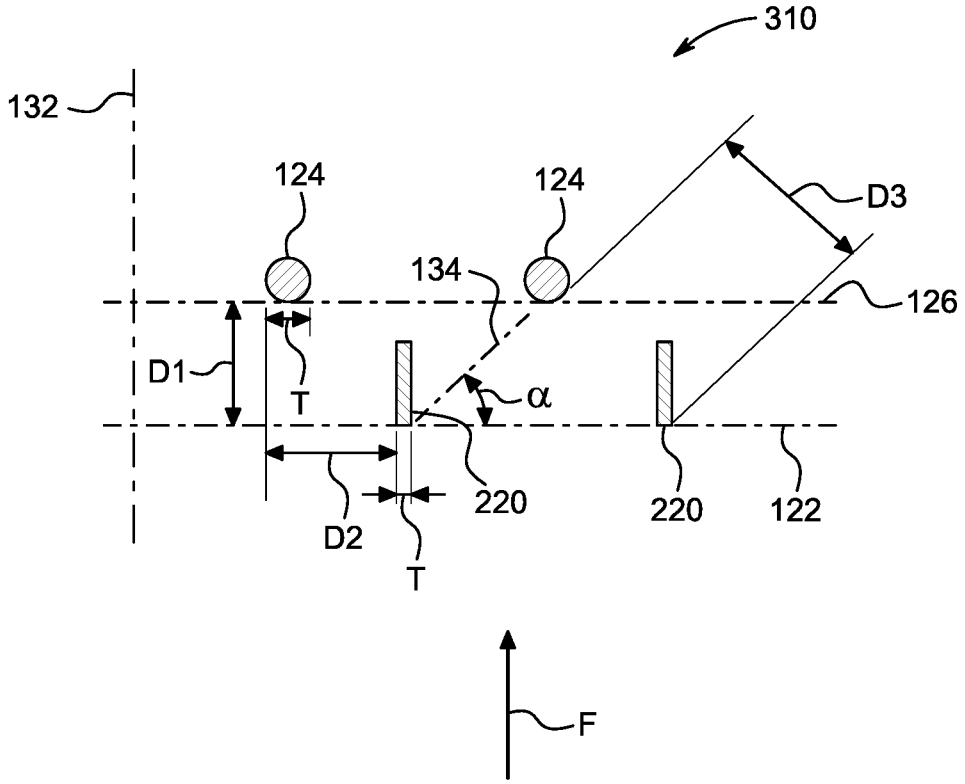
FIG. 5A is a cross-sectional view of wires of a grille assembly identical to FIG. 3, according to another embodiment of the present disclosure.

Referring to FIG. 5A, a cross sectional view of a grille assembly 310 is illustrated as shown in FIG. 3, according to an embodiment of the present disclosure. The construction of the grille assembly 310 is identical to the grille assembly 110 described with reference to the FIG. 2. The grille assembly 310 includes the plurality of first wires 220 disposed in the first plane 122 and the plurality of second wires 124 disposed in the second plane 126. Each of the plurality of first wires 220 and each of the plurality of second wires 124 may be supported by the ribs 114 and together configured to form the staggered structure 130. The open area for the grille assembly 310 may be determined based on the offset distance 'D1', the angle 'α', the linear distance 'D3', the horizontal distance 'D2' between the first wire 220 and the second wire 124 along the first plane 122 along the first plane 122, and the thickness 'T' of each of the plurality of first wires 220 and each of the plurality of second wires 124.

Figure 5B:
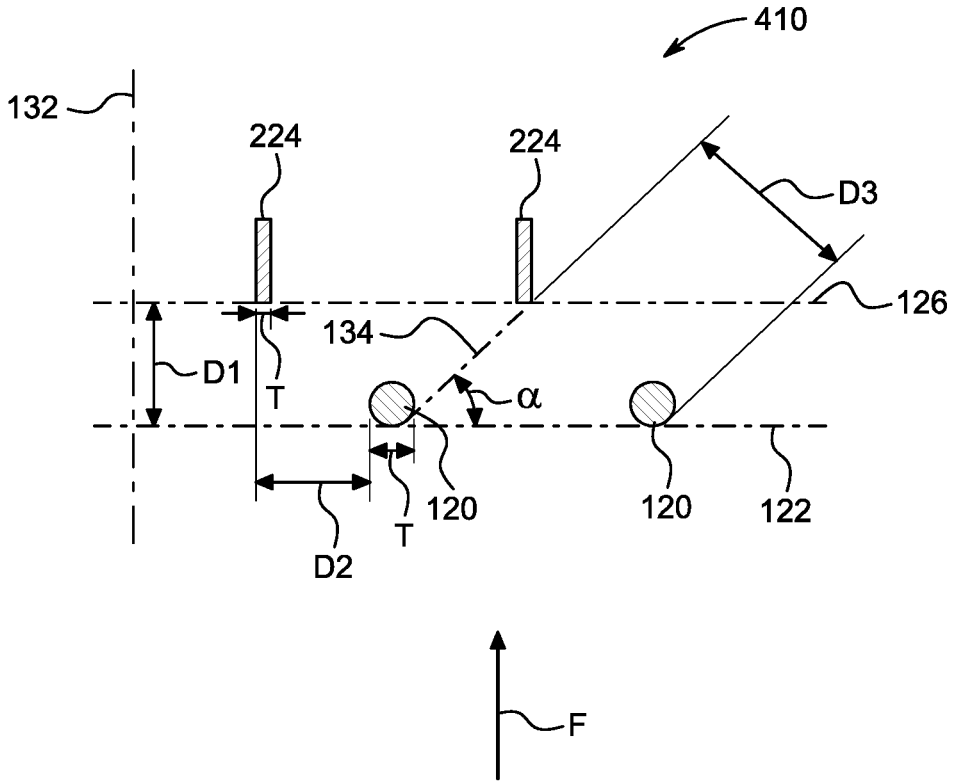
FIG. 5B is a cross-sectional view of wires of a grille assembly identical to FIG. 3, according to yet another embodiment of the present disclosure.

Referring to FIG. 5B, a cross sectional view of a grille assembly 410 is illustrated as shown in FIG. 3, according to an embodiment of the present disclosure. The construction of the grille assembly 410 is identical to the grille assembly 110 described with reference to the FIG. 2. The grille assembly 410 includes the plurality of first wires 120 disposed in the first plane 122 and the plurality of second wires 224 disposed in the second plane 126. Each of the plurality of the first wires 120 and the second wires 224 may be supported by the ribs 114. The open area for the grille assembly 410 may be determined based on the offset distance 'D1', the angle 'α', the linear distance 'D3', the horizontal distance 'D2' between the first wire 120 and the second wire 224 along the first plane 122 along the first plane 122, and the thickness 'T' of each of the plurality of first wires 120 and the second wires 224.

Figure 6:
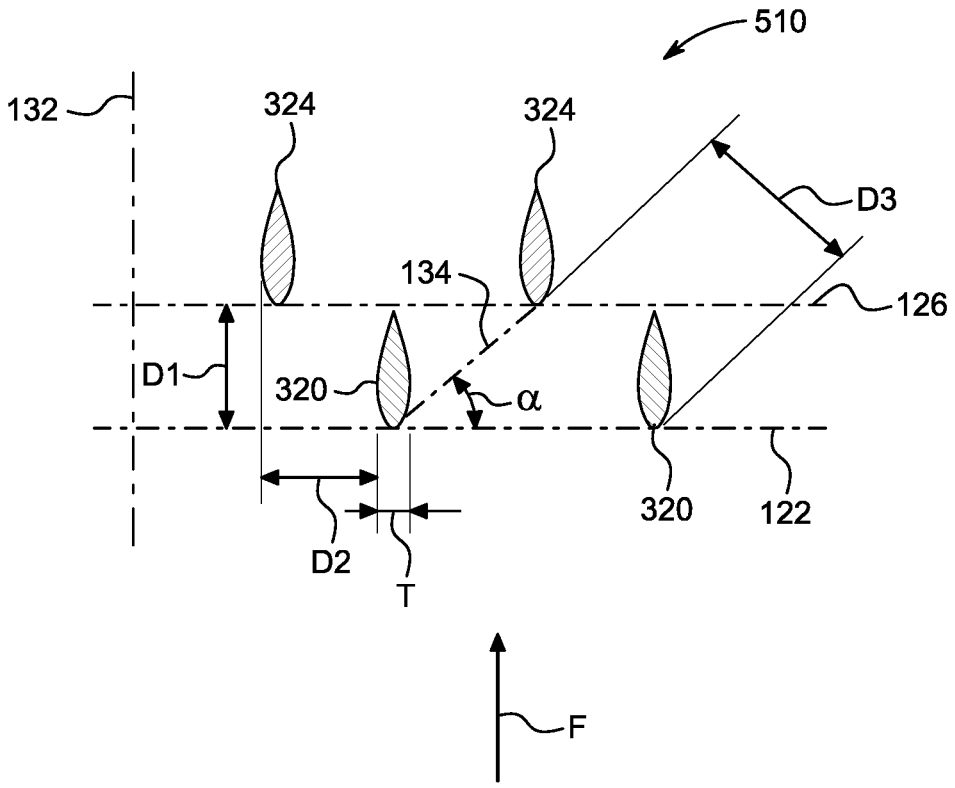
FIG. 6 is a cross-sectional view of wires of a grille assembly identical to FIG. 3, according to yet another embodiment of the present disclosure.

Referring to FIG. 6, a cross-sectional view of a grille assembly 510 is illustrated as shown in FIG. 3, according to an embodiment of the present disclosure. The construction of the grille assembly 510 is identical to the grille assembly 110 described with reference to the FIG. 2. The grille assembly 510 includes a plurality of first wires 320 disposed in the first plane 122 and a plurality of second wires 324 disposed in the second plane 126. Each of the plurality of first wires 320 and the second wires 324 may be supported by the ribs 114. Each of the plurality of first wires 320 and the second wires 324 have an aerofoil cross section. The open area for the grille assembly 510 may be determined based on the offset distance 'D1', the angle 'α', the linear distance 'D3', the horizontal distance 'D2' between the two adjacent wires including the first wire 320 and the second wire 324 along the first plane 122, and the thickness 'T' of each of the plurality of first wires 320 and the second wires 324. The thickness 'T' of each of the first wire 220 and the second wire 324 is identical. In an example, the thickness 'T' of the first wire 320 and the second wire 324 may be in a range of about 0.10 in to 0.15 in. Further, with the staggered configuration of the grille assembly 510, the CFM may be increased by 20 to 30 percentage over the existing grille assembly design.

Figure 7A:
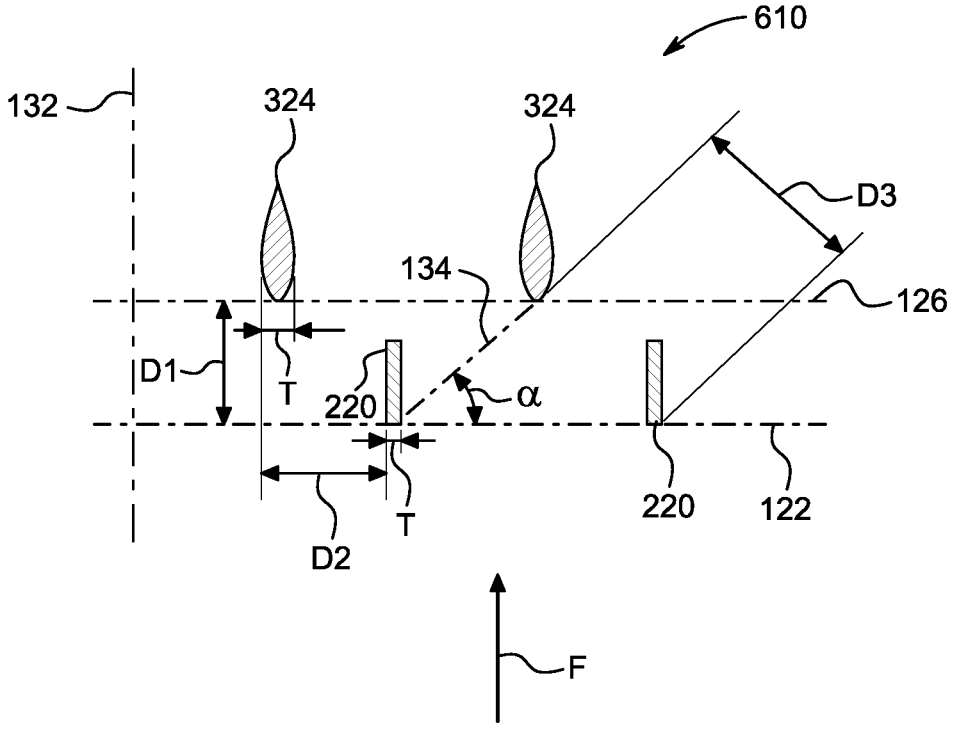
FIG. 7A is a cross-sectional view of wires of a grille assembly identical to FIG. 3, according to yet another embodiment of the present disclosure.

Referring to FIG. 7A, a cross-sectional view of a grille assembly 610 is illustrated as shown in FIG. 3, according to an embodiment of the present disclosure. The construction of the grille assembly 610 is identical to the grille assembly 110 described with reference to the FIG. 2. The grille assembly 610 includes the plurality of first wires 220 disposed in the first plane 122 and the plurality of second wires 324 disposed in the second plane 126. Each of the plurality of first wires 220 and the second wires 324 may be supported by the ribs 114. The open area for the grille assembly 610 may be determined based on the offset distance 'D1', the angle 'α', the linear distance 'D3', the horizontal distance 'D2' between the first wire 220 and the second wire 324 along the first plane 122, and the thickness 'T' of each of the plurality of first wires 220 and the second wires 324. The grille assembly 610 helps to increase flow coefficient and thus reduce air-flow pressure drop by having low drag coefficient and increased open area for the air flow.

Figure 7B:
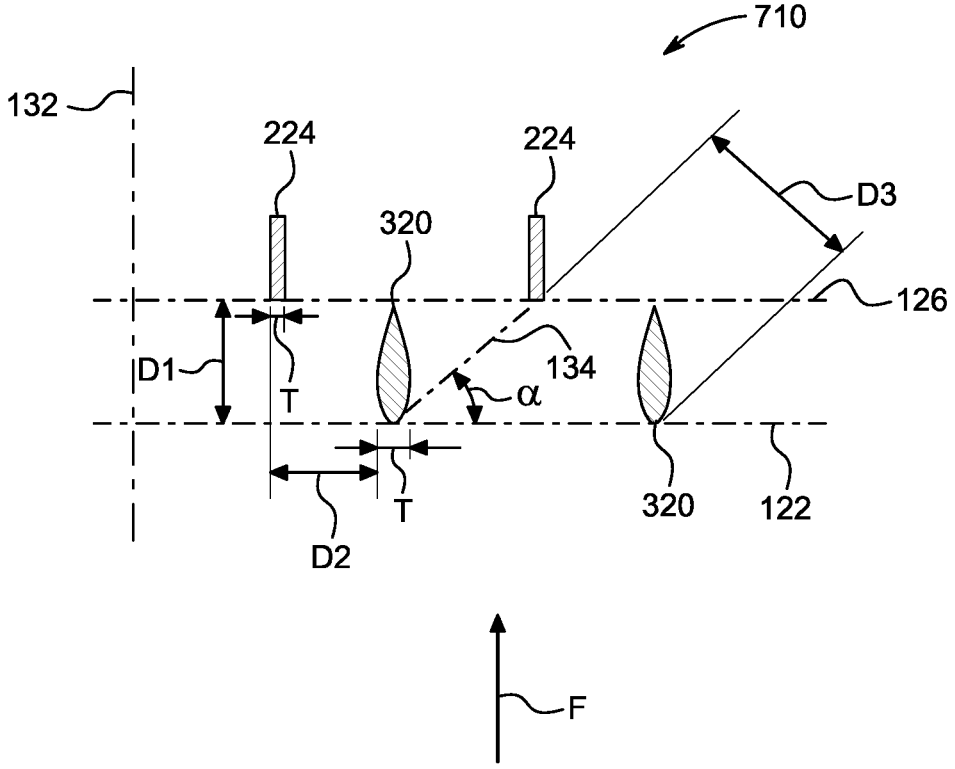
FIG. 7B is a cross-sectional view of wires of a grille assembly identical to FIG. 3, according to yet another embodiment of the present disclosure.

Referring to FIG. 7B, a cross-sectional view of a grille assembly 710 is illustrated as shown in FIG. 3, according to an embodiment of the present disclosure. The construction of the grille assembly 710 is identical to the grille assembly 110 described with reference to the FIG. 2. The grille assembly 710 includes the plurality of first wires 320 disposed in the first plane 122 and the plurality of second wires 224 disposed in the second plane 126. Each of the plurality of first wires 320 and the second wires 224 may be supported by the ribs 114. The open area for the grille assembly 710 may be determined based on the offset distance 'D1', the angle 'α', the linear distance 'D3', the horizontal distance 'D2' between the first wire 320 and the second wire 224 along the first plane 122, and the thickness 'T' of each of the plurality of first wires 320 and the second wires 224.

Figure 8A:
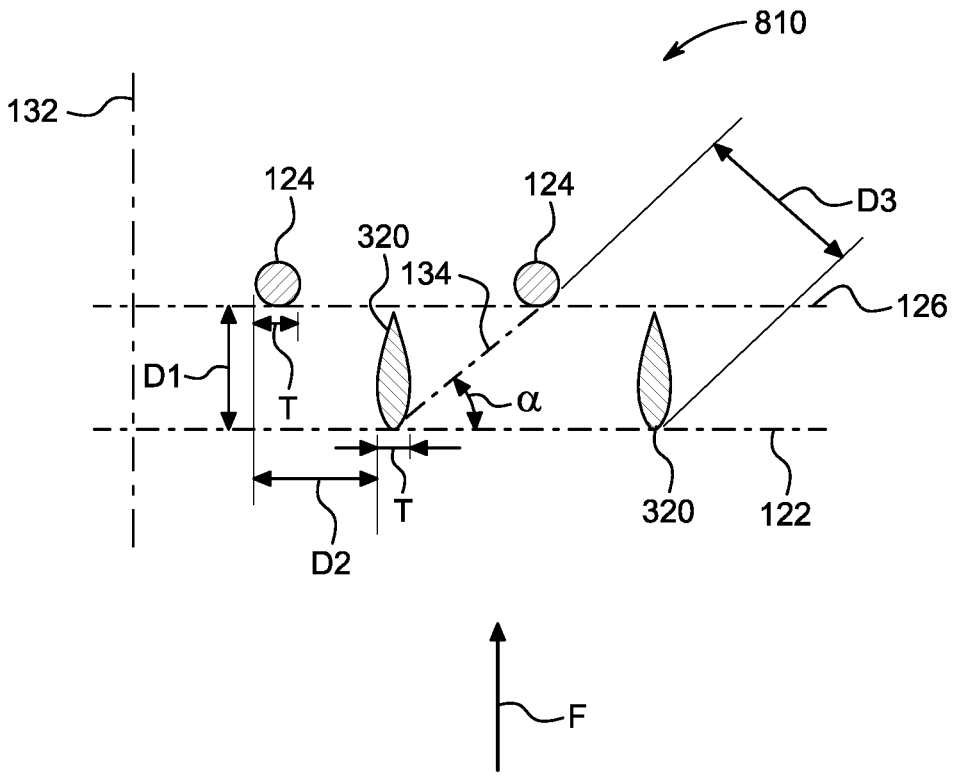
FIG. 8A is a cross-sectional view of wires of a grille assembly identical to FIG. 3, according to yet another embodiment of the present disclosure.

Referring to FIG. 8A, a cross-sectional view of a grille assembly 810 is illustrated as shown in FIG. 3, according to an embodiment of the present disclosure. The construction of the grille assembly 810 is identical to the grille assembly 110 described with reference to the FIG. 2. The grille assembly 810 includes the plurality of first wires 320 disposed in the first plane 122 and the plurality of second wires 124 disposed in the second plane 126. Each of the plurality of first wires 320 and the second wires 124 may be supported by the ribs 114. The open area for the grille assembly 810 may be determined based on the offset distance 'D1', the angle 'α', the linear distance 'D3', the horizontal distance 'D2' between the first wire 320 and the second wire 124 along the first plane 122, and the thickness 'T' of each of the plurality of first wires 320 and the second wires 124.

Figure 8B:
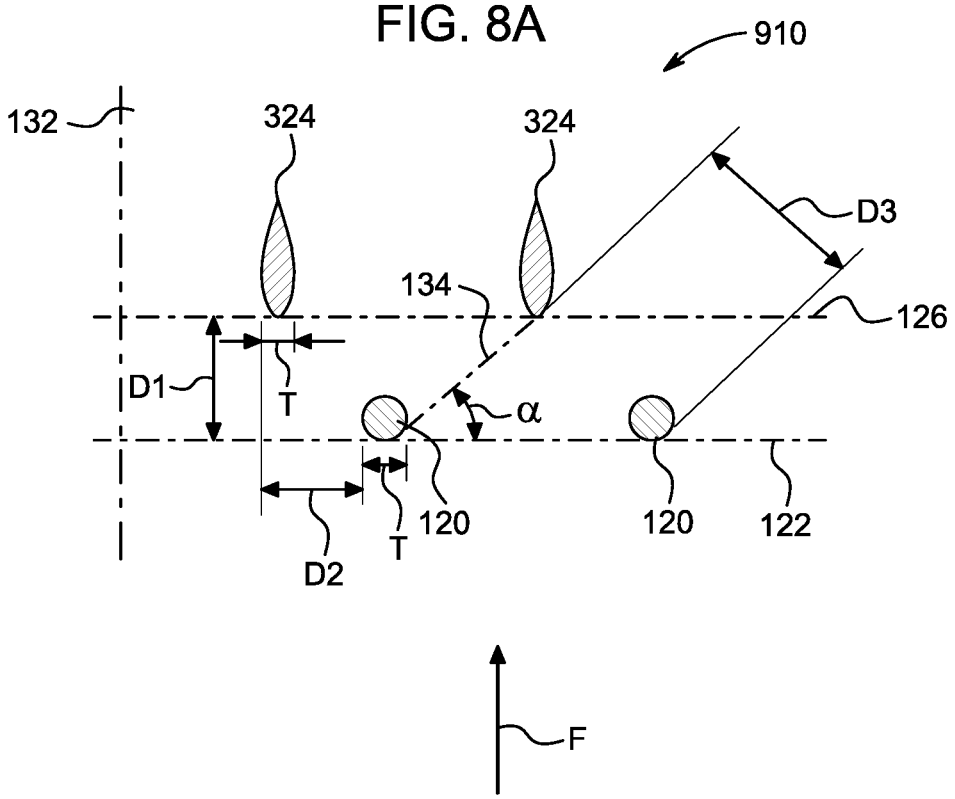
FIG. 8B is a cross-sectional view of wires of a grille assembly identical to FIG. 3, according to yet another embodiment of the present disclosure.

Referring to FIG. 8B, a cross-sectional view of a grille assembly 910 is illustrated as shown in FIG. 3, according to an embodiment of the present disclosure. The construction of the grille assembly 910 is identical to the grille assembly 110 described with reference to the FIG. 2. The grille assembly 910 includes the plurality of first wires 120 disposed in the first plane 122 and the plurality of second wires 324 disposed in the second plane 126. Each of the plurality of first wires 120 and the second wires 324 may be supported by the ribs 114. The open area for the grille assembly 910 may be determined based on the offset distance 'D1', the angle 'α', the linear distance 'D3', the horizontal distance 'D2' between the first wire 120 and the second wire 324 along the first plane 122, and the thickness 'T' of each of the plurality of first wires 120 and the second wires 324.

Figure 9:
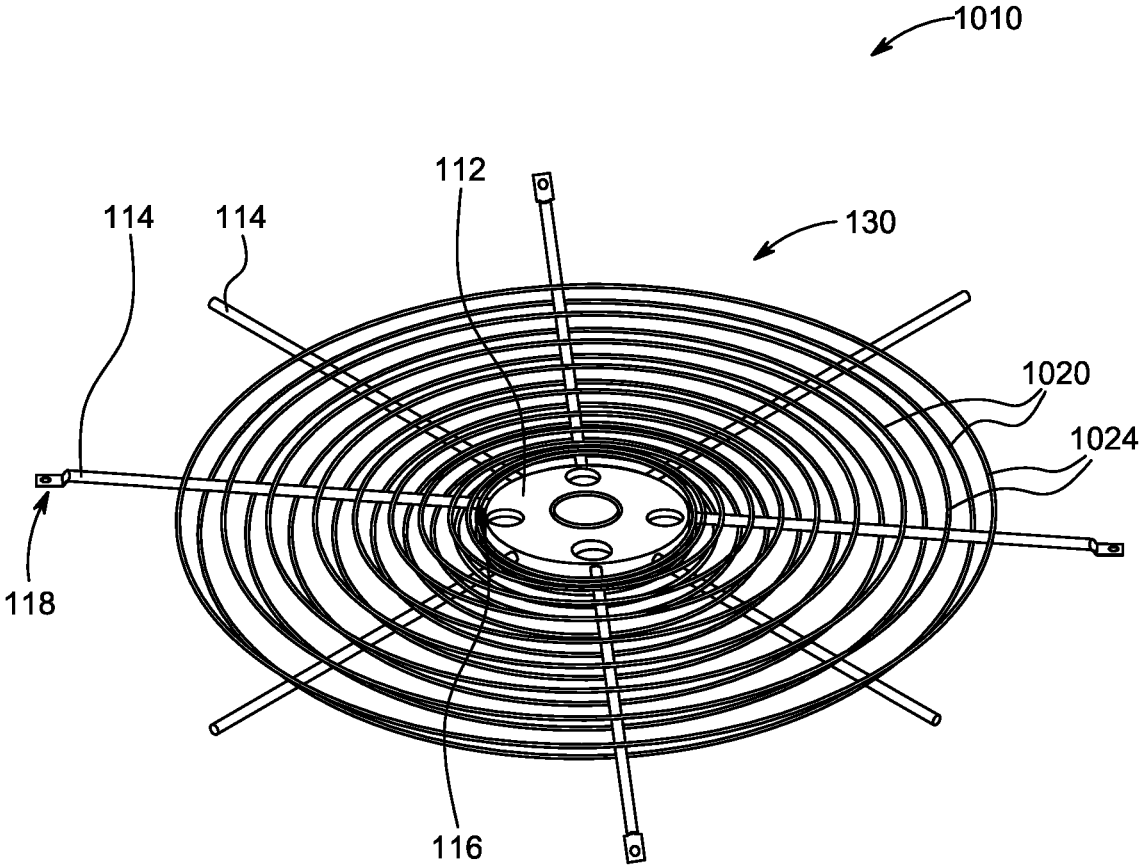
FIG. 9 is a perspective view of a grille assembly, according to one embodiment of the present disclosure.

Referring to FIG. 9, a perspective view of a grille assembly 1010 is illustrated, according to an embodiment of the present disclosure. The dimensional specification of the grille assembly 1010 is identical to the grille assembly 110 described with reference to the FIG. 2. The grille assembly 1010 includes a plurality of first wires 1020 disposed in the first plane 122 and a plurality of second wires 1024 disposed in the second plane 126. The plurality of first wires 1020 may define individual ring shapes of varying diameters and the plurality of second wires 1024 may define individual ring shapes of varying diameters. Each of the plurality of first wires 1020 and each of the plurality of second wires 1024 may be concentrically and radially disposed on the ribs 114. Particularly, each of the plurality of first wires 1020 and each of the plurality of second wires 1024 may be supported by the ribs 114 in the first plane 122 and the second plane 126, respectively, and together configured to enclose the air passage opening 106 and the rotating blades 104 within the housing 102. The various cross sections of the plurality of first wires, the plurality of second wires, and combinations thereof described with reference to FIG. 3 through FIG. 8B may be implemented in the grille assembly 1010. Further, the approach followed for determining the offset distance 'D1' and the open area explained with reference to the FIG. 3 may be implemented in the grille assembly 1010.

Figure 10:
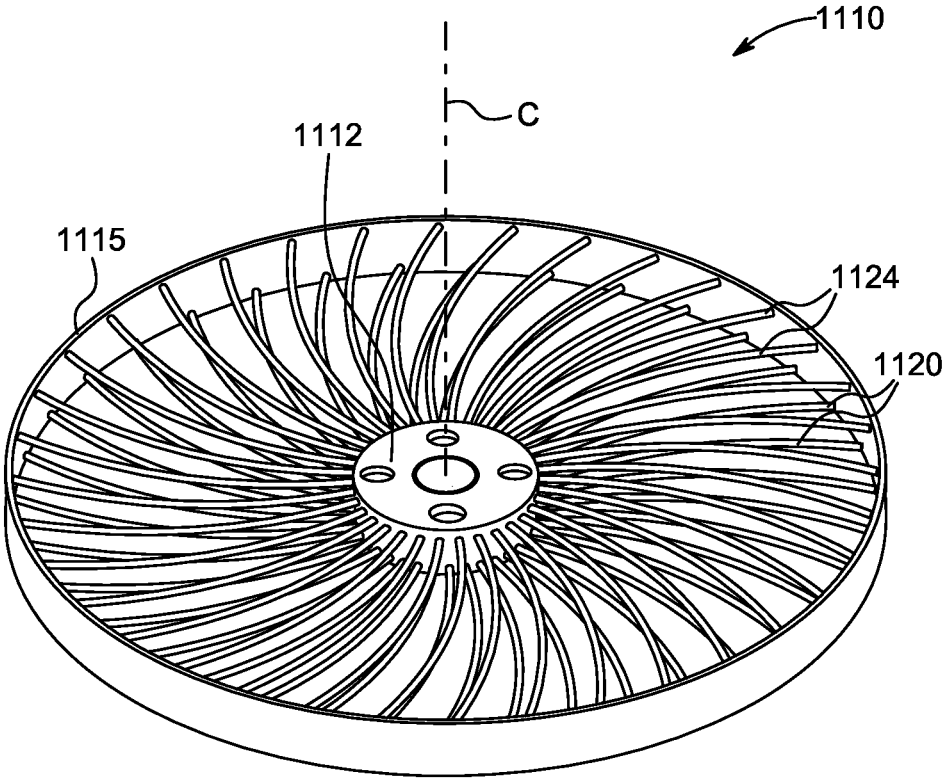
FIG. 10 is a perspective view of a grille assembly, according to another embodiment of the present disclosure.

Referring to FIG. 10, a perspective view of a grille assembly 1110 is illustrated, according to an embodiment of the present disclosure. The grille assembly 1110 includes a plurality of first wires 1120 disposed in the first plane 122 and a plurality of second wires 1124 disposed in the second plane 126. Particularly, the plurality of first wires 1120 and the plurality of second wires 1124 extend radially away from a central axis 'C' of the grille assembly 1110. In one embodiment, the grille assembly 1110 may include a plate 1112. First ends of each of the plurality of first wires 1120 and each of the plurality of second wires 1124 may be coupled to the plate 1112 and second ends thereof may be coupled to the peripheral edge of the air passage opening 106 of the housing 102. In another embodiment, the second ends of each of the plurality of first wires 1120 and each of the plurality of second wires 1124 may be coupled to an annular ring 1115 which in turn may engage with the peripheral edge of the air passage opening 106 of the housing 102. The various cross sections of the plurality of first wires, the plurality of second wires, and combinations thereof described with reference to FIG. 3 through FIG. 8B may be implemented in the grille assembly 1110. Further, the approach followed for determining the offset distance 'D1' and the open area explained with reference to the FIG. 3 may be implemented in the grille assembly 1110.

Figure 11:
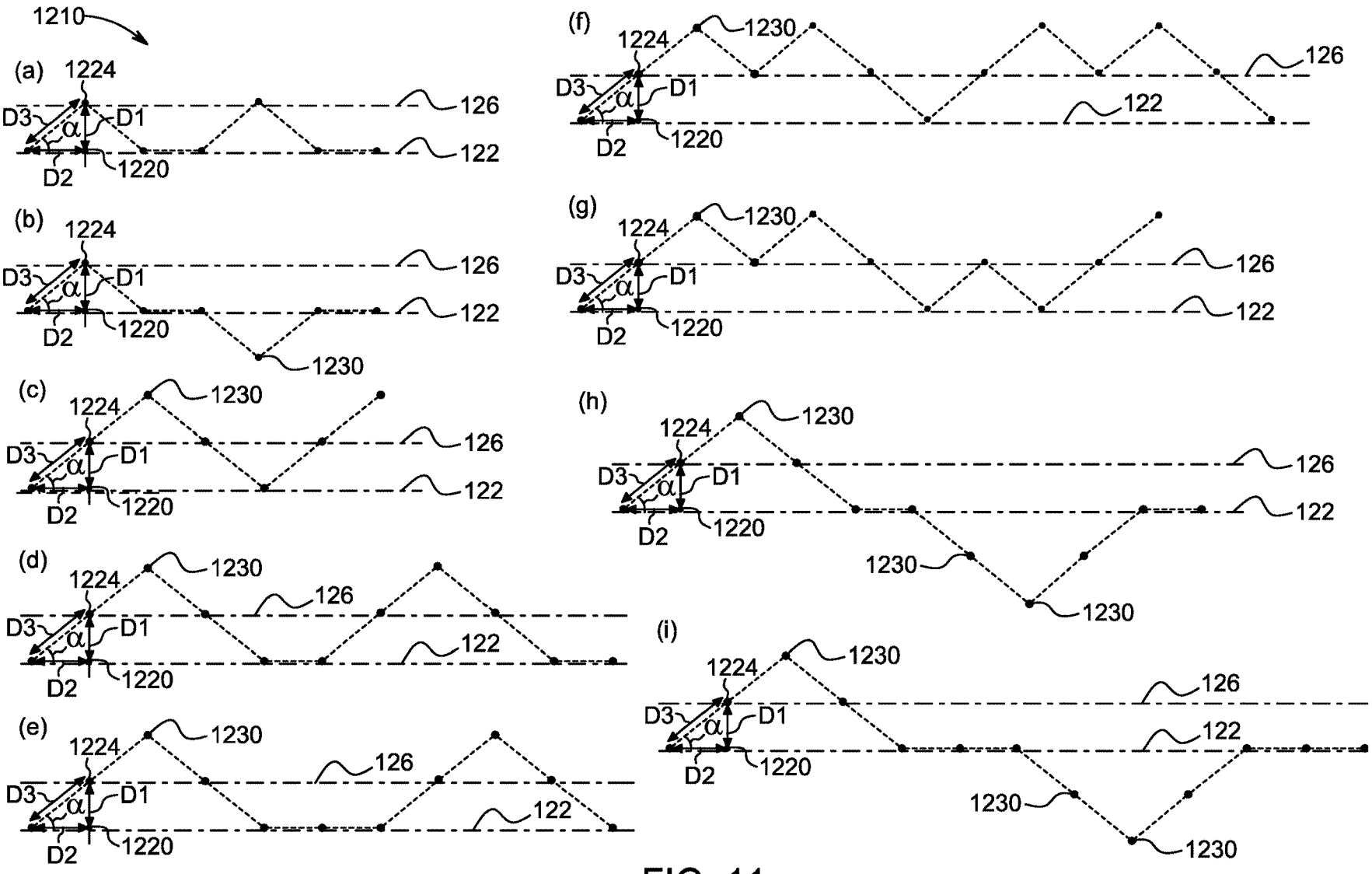
FIG. 11 illustrates schematic representations of various staggered configurations of wires of a grille assembly, according to certain embodiments of the present disclosure.

Referring to FIG. 11, schematic cross-sectional representations of various staggered configurations of a grille assembly 1210 are illustrated, according to certain embodiments of the present disclosure. The various staggered configurations of the grille assembly 1210 are designated as (a), (b), (c), (d), (e), (f), (g), (h), and (i). As described in FIG. 2 and FIG. 3, the grille assembly 1210 incudes a plurality of first wires, alternatively referred to as 'nodes 1220', disposed in the first plane 122 and a plurality of second wires, alternatively referred to as 'nodes 1224', disposed in the second plane 126. Further, the grille assembly 1210 includes a plurality of wires, alternatively referred to as 'nodes 1230', aligned in one or more planes adjacent the first plane 120 or the second plane 126. In one embodiment, the plurality of wires, or the nodes 1230, may be disposed in the one or more planes above the second plane 126. In another embodiment, the plurality of wires may be disposed in the one or more planes below the first plane 122. Each plane is parallel to the first plane 122 or the second plane 126. The open area for the grille assembly 1210 may be determined based on the offset distance 'D1', the angle 'α', the linear distance 'D3', the horizontal distance 'D2' between the node 1220 and the node 1224 along the first plane 122, and thickness of each of the plurality of first wires and the second wires. For example, the spacing between the each of two adjacent wires disposed in each of the two adjacent planes is defined less than or equal to 0.5 in.

INDUSTRIAL APPLICABILITY

The present disclosure relates to the grille assembly 110 having the staggered structure 130 to enclose the air passage opening 106 and the rotating blades 104 within the housing 102 of the air handling unit 100 as described in FIG. 2 and FIG. 3. The present disclosure also relates to various embodiments of the grille assemblies 210, 310, 410, 510, 610, 710, 810, 910, 1010, 1110 and 1210 in described with reference to FIG. 4 through FIG. 11. Further, the various cross sections of the plurality of first wires, the plurality of second wires, and combinations thereof described with reference to FIG. 3 through FIG. 8B may also be implemented along with the staggered configurations (a), (b), (c), (d), (e), (f), (g), (h), and (i) illustrated with reference to FIG. 11.

For the sake of brevity and clarity, the grille assembly 110 is described in detail herein below. The grille assembly 110 includes the plurality of first wires 120 and the plurality of second wires 124, in which each of the plurality of first wires 120 is disposed in the first plane 122 and each of the plurality of second wires 124 is disposed in the second plane 126. The second plane 126 is distal to the first plane 122 by the offset distance 'D1', which is measured as the distance between the first plane 122 and the second plane 126 along the third plane 132. The offset distance 'D1' is further determined based on the horizontal distance 'D2' measured between the two adjacent wires along the first plane 122 and the angle 'α' defined between the inclined plane 134 and the first plane 122. Further, the offset distance 'D1' may be determined based on the thickness 'T' of each of the plurality of first wires 120 and the second wires 124. In an embodiment, the thickness of the first wire 120, 220, 320 and the second wire

124, 224, 324 is in a range of about 0.05 in to about 0.16 in. Thus, the open area defined between the two adjacent wires increases compare to that of defined between two adjacent wires when the angle 'α' is zero degree or close to zero degree. Increasing the angle 'α' causes increase in the linear distance 'D3' between the two adjacent wires and the offset distance 'D1' between the first plane 122 and the second plane 126, and hence the open area available for the air to flow therethrough also increases. For example, the spacing between the two adjacent wires, alternatively the linear distance 'D3' between the adjacent wires, is maintained less than or equal to 0.5 in. Such increase in the open area further lead to increase in the rate of flow of air through the grille assembly 110, which in turn lead to increase in the quantity of air discharged through the grille assembly 110.

The staggered configurations of the present disclosure help to reduce noise caused by the air flowing over the grille assembly 110. Further, performance of any machineries such as heating and cooling systems implementing the grille assembly 110 of the present disclosure may be improved due to increased flow of air within the machineries. The plurality of wires may be manufactured by pressing base material in molds, by extruding or by 3D printing methods. Further, the plurality of wires may be made of materials such as metals, alloys, composites, or synthetic materials. The base materials may be further coated with paint or thermoplastic powder to retain cross sectional shape and prolife of the wires and hence to extend life of the wires. The plate 112 and the ribs 114 may be made from the same material used for manufacturing the wires.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. A grille assembly comprising:

a plurality of first wires aligned substantially parallel to one another along a first plane perpendicular to a direction of flow of air; and a plurality of second wires aligned substantially parallel to one another along a second plane perpendicular to the direction of flow of air, wherein the plurality of first wires and the plurality of second wires are together configured to form a staggered structure to at least partly enclose an air passa ge opening of the air handling unit, and wherein the second plane is parallel to the first plane and separated by an offset distance along a third plane parallel to the direction of flow of air.

2. The grille assembly of claim 1, wherein the offset distance depends on a horizontal distance between two adjacent wires along the first plane, and wherein the two adjacent wires comprise a first wire of the plurality of first wires and a second wire of the plurality of first wires.

3. The grille assembly of claim 2, wherein the horizontal distance between the two adjacent wires is in a range of about 0.2 in to about 1.76 in.

4. The grille assembly of claim 1, wherein the offset distance depends on an angle between an inclined plane defined by two adjacent wires and the first plane, and wherein the two adjacent wires comprise a first wire of the plurality of first wires and a second wire of the plurality of first wires, and wherein the two adjacent wires are parallel within the inclined plane.

5. The grille assembly of claim 4, wherein the angle between the inclined plane and the first plane is in a range of about 5 degrees to about 80 degrees.

6. The grille assembly of claim 1, wherein a linear distance between a first wire of the plurality of first wires and a second wire of the plurality of first wires is in a range of about 0.25 in to about 0.5 in, wherein the linear distance is a separate distance from a horizontal distance between the first wire and second wire.

7. The grille assembly of claim 1, wherein a thickness of a first wire of the plurality of first wires and a second wire of the plurality of first wires is in a range of about 0.05 in to about 0.16 in.

8. The grille assembly of claim 1, wherein each of the plurality of first wires and each of the plurality of second wires have a circular cross section.

9. The grille assembly of claim 1, wherein each of the plurality of first wires and each of the plurality of second wires have a rectangular cross section.

10. The grille assembly of claim 1, wherein each of the plurality of first wires and each of the plurality of second wires have an aerofoil cross section.

11. The grille assembly of claim 1 further comprises a plurality of ribs configured to support each of the plurality of first wires and each of the plurality of second wires in the first plane and the second plane, respectively.

12. The grille assembly of claim 11, wherein the staggered structure comprises each of the plurality of first wires formed as a single wire and spirally disposed on the plurality of ribs in the first plane and each of the plurality of second wires formed as a single wire and spirally disposed on the plurality of ribs in the second plane.

13. The grille assembly of claim 11, wherein the staggered structure comprises each of the plurality of first wires and each of the plurality of second wires individually defining a ring shape and concentrically disposed on the plurality of ribs in the first plane and the second plane, respectively.

14. The grille assembly of claim 1, wherein the staggered structure comprises each of the plurality of first wires and each of the plurality of second wires extending radially away from a central axis of the grille assembly and aligned in the first plane and the second plane, respectively.

15. The grille assembly of claim 1 further comprising a plurality of wires aligned in one or more planes defined adjacent the first plane or the second plane, wherein the one or more planes are parallel to the first plane or the second plane.

16. The grille assembly of claim 1, wherein each of the plurality of first wires have a first cross section and each of the plurality of second wires have a second cross section, wherein the first cross section and second cross section are different, and wherein the first cross section and second cross section comprise at least one of: an aerofoil cross section a rectangular cross section, and a circular cross section.

17. A grille assembly comprising:

a plurality of first wires aligned substantially parallel to one another along a first plane perpendicular to a direction of flow of air; and a plurality of second wires aligned substantially parallel to one another along a second plane perpendicular to the direction of flow of air, wherein the plurality of first wires and the plurality of second wires are together configured to form a staggered structure to at least partly enclose an air passage opening of the air handling unit, and wherein the second plane is parallel to the first plane and separated by an offset distance along a third plane parallel to the direction of flow of air, wherein the offset distance depends on:

a horizontal distance between two adjacent wires along the first plane;

an angle between an inclined plane defined by the two adjacent wires and the first plane, wherein the two adjacent wires comprise the first wire and the second wire, and wherein the two adjacent wires are parallel within the inclined plane; and a thickness of the first wire and the second wire.

18. A grille assembly comprising:

a plate;

a plurality of ribs having first ends coupled to the plate and second ends distal to the first ends and extending radially away from the plate;

a first wire defining a first set of loops aligned substantially parallel to one another along a first plane perpendicular to a direction of flow of air; and a second wire defining a second set of loops aligned substantially parallel to one another along a second plane perpendicular to the direction of flow of air, wherein the first wire and the second wire are radially disposed on the plurality of ribs and together configured to form a staggered structure to at least partly enclose an air passage opening of the air handling unit, and wherein the second plane is parallel to the first plane and separated by an offset distance along a third plane parallel to the direction of flow of air.

19. The grille assembly of claim 18, wherein the offset distance depends on:

a horizontal distance between two adjacent wires along the first plane;

an angle between an inclined plane defined by the two adjacent wires and the first plane, wherein the two adjacent wires comprise the first wire and the second wire; and a thickness of the first wire and the second wire.

* * * * *